US006517264B1

(12) United States Patent
Earle et al.

(10) Patent No.: US 6,517,264 B1
(45) Date of Patent: Feb. 11, 2003

(54) PROCESSING APPARATUS

(75) Inventors: Anthony Earle, Middlesex (GB); Robert A. Arcus, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/176,182

(22) Filed: Jun. 20, 2002

(30) Foreign Application Priority Data

Jul. 10, 2001 (GB) ..... 0116800

(51) Int. Cl.[7] ..... G03D 3/04
(52) U.S. Cl. ..... 396/634; 396/635
(58) Field of Search ..... 396/571, 633, 396/634, 635; 355/27–29; 134/64 P, 64 R, 122 P, 122 R, 120, 157; 118/424, 427

(56) References Cited

U.S. PATENT DOCUMENTS

| | | | | | |
|---|---|---|---|---|---|
| 3,668,997 | A | * | 6/1972 | Ratowsky | 396/635 |
| 3,673,985 | A | * | 7/1972 | Dols | 396/634 |
| 3,727,535 | A | * | 4/1973 | Streeter | 396/634 |
| 4,444,480 | A | * | 4/1984 | Freeman | 396/634 |
| 5,418,593 | A | | 5/1995 | Fyson | 396/635 |

* cited by examiner

*Primary Examiner*—D. Rutledge
(74) *Attorney, Agent, or Firm*—Frank Pincelli

(57) ABSTRACT

A processing drum is located within an enclosed chamber. The processing drum is rotated within the chamber, the chamber being provided with means to heat and circulate air throughout the interior thereof. At least one fin is provided around the outer periphery of the drum to aid heat conduction.

5 Claims, 2 Drawing Sheets

PROCESSING APPARATUS

FIELD OF THE INVENTION

This invention relates to processing apparatus, in particular to processing chambers for the processing of photographic material.

BACKGROUND OF THE INVENTION

It is normal in photographic processing machines to use the chemicals that are carried in the reaction tanks to heat the mechanical components of the machine as well as the interior of the processor. It is also well known to use a heated water bath to surround the reaction chambers to heat them and the mechanical components in the processor. While this ensures stable temperatures can be maintained easily it has the disadvantage of holding the active chemicals at elevated temperatures for long periods of time. This leads to oxidation of the chemicals and loss of performance. This may be acceptable if the machine usage, and hence replenishment, is frequent but in walk up kiosk type machines usage can be very sporadic. A further disadvantage when using solutions to heat instant access kiosk type machines is that it must be ensured that the chemicals give the correct reactions. Keeping the chemicals hot over long periods would entail frequent additions of fresh chemicals, thus increasing both waste and cost. The chemicals could be kept cool but heat up times would add an unacceptable delay to the walk up instant features of a kiosk type processor.

It is known that some processors use fresh chemistry each time and rely on hot air to maintain the empty process chamber temperature over long periods of inactivity. A typical processor of this type is disclosed in U.S. Ser. No. 09/920,495, the contents of which are herein incorporated by reference.

The invention aims to provide a method and apparatus in which the above mentioned problems are overcome. As the chemicals required in these processors are of a very small volume it is necessary to bring them to a uniform and optimum temperature quickly and maintain it during the process. To this end it is important to ensure even and uniform air temperatures in the machine by avoiding stagnant or dead areas in the chamber. It is also necessary to transfer the heat quickly and uniformly from the air to the processing drum and then to the chemicals.

SUMMARY OF THE INVENTION

This invention overcomes the limitations imposed by having to heat large volumes of liquid and hold them for long periods while maintaining their activity. The invention also ensures uniform air distribution in the chamber and good heat transfer to the processing drum and chemicals.

According to the present invention there is provided an apparatus for processing a photographic material comprising an enclosure chamber, a processing chamber located within the enclosure chamber and adapted to hold the material therein, means for rotating the processing chamber and means for heating and circulating air throughout the enclosure chamber, the processing chamber being provided with at least one fin around the outer periphery thereof Preferably a closed end of the processing chamber or drum is provided with at least one impeller fin.

The present invention further provides a method of maintaining uniform temperature in a processing apparatus, the apparatus comprising an enclosure chamber, a processing chamber located within the enclosure chamber and adapted to hold material therein, means for rotating the processing chamber and means for heating and circulating air throughout the enclosure chamber, the processing chamber being provided with at least one fin around the outer periphery thereof, the processing chamber being rotated continuously, whether or not material is being processed within the processing chamber, thereby continuously moving heated air around the enclosure chamber.

The fins on the outside periphery of the drum and the impeller fins radiating out from the centre on the back plane of the drum increase the surface area, improving the mass to surface area aiding heat transfer while the back impeller fins move the air around the enclosure chamber as the drum rotates.

A uniform temperature distribution is achieved, using air to heat both the process and the machine. This aids in uniform processing of a material along its length.

The temperature variation of the process chemicals is reduced along the length of the material and from strip to strip of material. It is possible to maintain the processing machine at a uniform temperature over long periods of inactivity. Warm up time for single use kiosks is eliminated due to the chemical temperatures quickly and uniformly reaching the set running temperature of the chamber as the drum rotates and the processing solution rolls around the inner surface of the drum. The invention also reduces the need to hold large volumes of chemicals at elevated temperatures which eliminates long term aerial oxidation in the processing chambers. The volume of chemicals in the machine is reduced as the chemical solutions can be drawn off as they are required, heated and then disposed of after use. The life time of the chemicals is thereby prolonged as they can be kept in cool airtight containers which may be sealed at the manufacturing plant and then drawn off, in single use volumes, by the processing machine through an airtight interface coupling such as the type used in the Kodak 'SM' chemical management system mini-labs.

BRIEF DESCRIPTION OF THE DRAWINGS

The invention will now be described, by way of example, with reference to the accompanying drawings, in which.

DETAILED DESCRIPTION OF THE INVENTION

Figure 1:
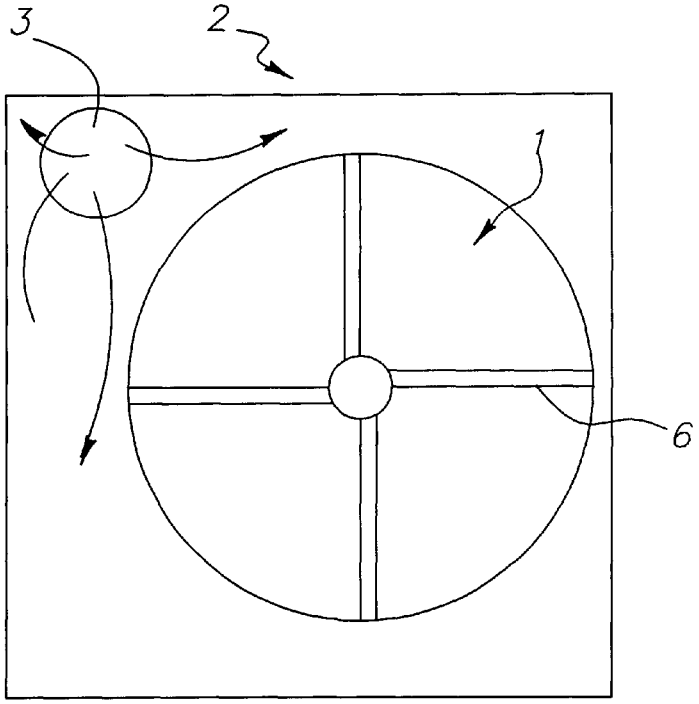
FIG. 1 is a schematic front view of an apparatus according to the present invention.
Figure 2:
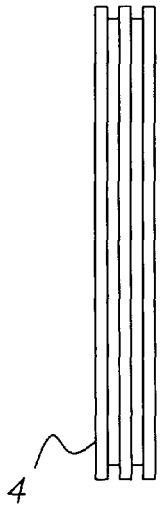
FIG. 2 is a side view of the processing chamber or drum.
Figure 3:
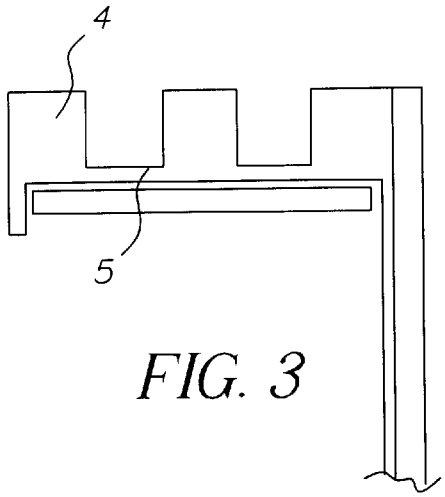
FIG. 3 is a schematic enlarged view of the wall of the processing chamber or drum.

FIGS. 1, 2 and 3 show schematic views of the processing unit according to the invention.

A rotating processing drum 1 is mounted within an enclosure chamber 2. The drum 1 comprises a cylinder having at least one closed end. The drum 1 can be made of any suitable heat conducting metal or plastics material. The cylinder defines the processing chamber. A suitable drum 1 is disclosed in co-pending application no U.S. Ser. No. 09/920,495, as quoted above. However any suitable low volume processor can be used. The drum 1 is provided with at least one fin 4 on the outer periphery 5 thereof In the embodiment shown the drum is provided with a plurality of fins 4. These can be seen in FIGS. 2 and 3. The closed end of the drum is provided with impeller fins 6 radiating out from the centre thereof These impeller fins 6 may be straight as shown in FIG. 1 or they may be curved. The cross section of the fins 6 may be constant or varying. A fan and heater 3 is also located within the enclosure chamber 2.

Figure 4:
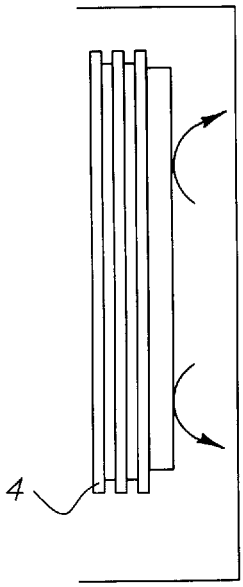
FIG. 4 is a front view indicating the flow of air around the apparatus according to the invention.
Figure 5:
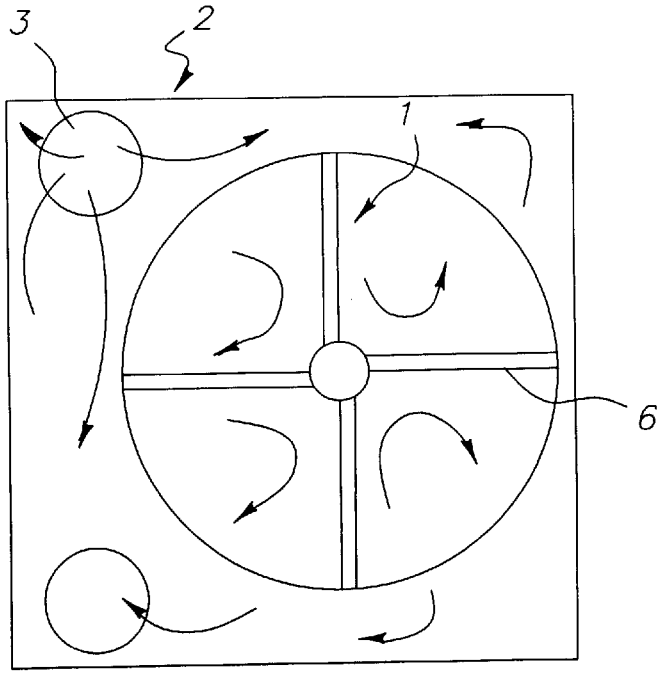
FIG. 5 is a side view indicating the flow of air around the apparatus.

The drum 1 is empty when no processing takes place. However the drum is constantly rotated, even when in standby mode. Hot air is circulated within the enclosure chamber 2 by the fan and heater 3. FIGS. 4 and 5 illustrate how the hot air moves around the rear of the drum. Further movement around the rear of the drum is created by the impeller fins 6. The constant movement of the hot air ensures that no dead spots or hot spots are created. The provision of the fins 4 greatly increases the surface area of the drum chamber. The more fins are provided the greater the surface area of the drum. As the surface area is increased the heat transfer is improved. The drum is therefore kept at a temperature suitable for processing photographic material.

The material to be processed is loaded into the drum. The processing solutions to be used are drawn out of their storage containers and are preheated just prior to being introduced to the material inside the processing drum. As only very low volumes of solutions are required the solution can be further heated by the set temperature of the drum once it is inside or the temperature can be accurately maintained by the drum/chamber air temperature as desired. This ensures the correct temperature for the process is reached and held. The uniformity of the temperature throughout the rotating drum is transferred by conduction to the material and solution ensuring that even processing takes place along the length of the material.

The invention has been described in detail with reference to preferred embodiments thereof. It will be understood by those skilled in the art that variations and modifications can be effected within the scope of the invention.

PARTS LIST

1. processing drum
2. enclosure chamber
3. fan and heater
4. fin
5. outer periphery
6. impeller fin

What is claimed is:

1. Apparatus for processing a photographic material comprising an enclosure chamber, a processing chamber located within the enclosure chamber and adapted to hold the material therein, means for rotating the processing chamber and means for heating and circulating air throughout the enclosure chamber, the processing chamber being provided with at least one fin around the outer periphery thereof.

2. Apparatus as claimed in claim 1 wherein the processing chamber has at least one closed end, this end being provided with at least one impeller fin to provide air movement and substantially uniform temperature throughout the enclosure chamber.

3. Apparatus as claimed in claim 2 wherein the at least one impeller fin has a constant cross sectional area.

4. Apparatus as claimed in claim 2 wherein the at least one impeller fin has a varying cross sectional area.

5. A method of maintaining uniform temperature in a processing apparatus, the apparatus comprising an enclosure chamber, a processing chamber located within the enclosure chamber and adapted to hold material therein, means for rotating the processing chamber and means for heating and circulating air throughout the enclosure chamber, the processing chamber being provided with at least one fin around the outer periphery thereof, the processing chamber being rotated continuously, whether or not material is being processed within the processing chamber, thereby continuously moving heated air around the enclosure chamber.

* * * * *